United States Patent [19]

Colli et al.

[11] Patent Number: 4,809,927

[45] Date of Patent: Mar. 7, 1989

[54] YARN TENSIONING DEVICE IN THE FORM OF ROTARY DISCS

[75] Inventors: Luigi Colli; Sergio Monego, both of Pordenone, Italy

[73] Assignee: Savio S.p.A., Pordenone, Italy

[21] Appl. No.: 127,110

[22] Filed: Dec. 1, 1987

[30] Foreign Application Priority Data

Dec. 1, 1986 [IT] Italy ..... 22522 A/86

[51] Int. Cl.[4] ..... B65H 59/22

[52] U.S. Cl. ..... 242/150 R

[58] Field of Search ..... 242/150 R, 150 M, 149, 242/147 R, 147 M

[56] References Cited

U.S. PATENT DOCUMENTS

| | | | |
|---|---|---|---|
| 1,311,448 | 7/1919 | Holt et al. | 242/150 R |
| 1,456,263 | 5/1923 | Van Hess . | |
| 1,965,363 | 7/1934 | Abbott | 242/150 R |
| 2,457,450 | 12/1948 | Dewas . | |
| 2,646,944 | 7/1953 | Heffelfinger | 242/150 R |
| 2,781,181 | 2/1957 | Ayars, Jr. | 242/150 R |
| 2,881,988 | 4/1959 | Warwick . | |
| 2,965,332 | 12/1960 | Perry | 242/150 R |
| 3,146,969 | 9/1964 | Lindsey | 242/150 R |
| 3,459,389 | 8/1969 | Wildi et al. | 242/150 R |
| 4,175,718 | 11/1979 | Derichs et al. | 242/150 R |
| 4,202,511 | 5/1980 | Koslowski | 242/150 R |
| 4,272,038 | 6/1981 | Wildi | 242/150 R |
| 4,548,369 | 10/1985 | Bossart | 242/150 R |

FOREIGN PATENT DOCUMENTS

| | | | |
|---|---|---|---|
| 683748 | 12/1966 | Belgium . | |
| 1586649 | 2/1970 | France . | |
| 2232503 | 1/1975 | France . | |
| 162323 | 4/1921 | United Kingdom | 242/150 R |
| 186437 | 10/1922 | United Kingdom | 242/150 R |
| 366157 | 2/1932 | United Kingdom | 242/150 R |

*Primary Examiner*—Stanley N. Gilreath

*Attorney, Agent, or Firm*—Hedman, Gibson, Costigan & Hoare

[57] ABSTRACT

A disc-type yarn tensioner consisting of one or more tensioning elements in series, each composed of a pair of idly-rotating mutually facing discs of which the first disc is able to undergo only rotary movement whereas the second disc is able to rotate, translate axially, and incline its axis of rotation by the effect of the engagement between a rotating cylindrical cavity and a fixed spherical surface.

4 Claims, 1 Drawing Sheet

YARN TENSIONING DEVICE IN THE FORM OF ROTARY DISCS

This invention relates to a tensioning device which enables a constant regulated tension to be provided to the yarn during yarn production and finishing.

This device, commonly known as a yarn tensioner, is of particular importance in spooling because correct yarn tension regulation is essential for the proper outcome of this operation.

In this respect, it should be noted that the crude semi-processed yarn which is fed to the spooling operation still comprises considerable irregularities, which have to be at least substantially reduced during this stage.

Yarn tensioning devices of various types are described in the known art.

Devices are known in the form of a pair of discs—or washers—between which the yarn is passed.

The pressure between the discs is adjustable by lever mechanisms, by gravity, by weights or by pneumatic pistons.

In other more basic types, one of the discs is in the form of a non-rotating block.

In a very common version, these devices are motorized by driving one of the two discs or washers, the other being entrained. The yarn passes substantially at the centre of the washers, and the tension is provided by the effect of the pressure, ie of the friction between the yarn and washers.

The tensioning action is adjustable both by adjusting the pressure between the washers and by adjusting the speed at which the motor rotates the drive washer.

However, this known device has considerable drawbacks because the tension is conferred in only one portion of the yarn, and thus with hairy or powdery filaments the yarn deteriorates.

So-called peeling occurs, and build-ups of fluff or accumulated dust become concentrated and entrained.

In this case, the tensioning device itself creates or emphasises the irregularities, which instead should be reduced during spooling.

In a more recent device, these drawbacks are reduced by disposing two pairs of mutually facing idle rollers in sequence, these being rotated by the yarn itself which no longer slides at the centre of the washers but on a rotating pin of small diameter, so that the friction forces between the yarn and washers generate a tangential force which rotates the washers.

By dividing the tensioning action into two positions, the tension is able to be applied progressively to the yarn rather than being concentrated in a single portion, thus reducing the tendency for peeling and for the formation of groups or build-ups.

Of these idle washers, only one is free to move axially and the pressure necessary for tensioning the yarn is applied to it, this normally being sufficient for the washers to be conveniently rotated by the yarn. The yard tension is related to the resistance which the washers oppose to entrainment.

When a concentrated irregularity in the yarn arrives, the axially mobile washer adapts to it by withdrawing.

Contact between the yarn and washers is then limited to only that portion corresponding to the irregularlity, and the tensioning action is correspondingly limited. The result is that in correspondence with a concentrated irregularity in the yarn, the tension transmitted to the yarn tends to decrease.

This drawback is also common in the aforesaid disc tensioning devices. The tensioning device according to the present invention enables the position of the pairs of discs to be adapted to the yarn irregularities while keeping them always in mutual engagement, ie while maintaining the tensioning action even in correspondence with such irregularities.

The tensioning device according to the present invention consists of one or more pairs of mutually facing idle discs between which the yarn to be tensioned is positioned.

Each pair of discs consists substantially of an idle disc—or washer—able to rotate but not to move in the axial direction, and a second disc kept pressing against the first disc and capable of three movements:

idle rotary movement about its axis;

axial movement which keeps it adhering to the first dicsc;

sufficient oscillatory movement of its axis of rotation by the engagement between a rotary hollow cylinder and a fixed spherical surface disposed in the hollow cylinder.

The invention is described hereinafter with reference to FIGS. 1 and 2 which show a typical embodiment of the tensioning device comprising two consecutive tensioning elements each consisting of a pair of discs wherein.

Figure 1:
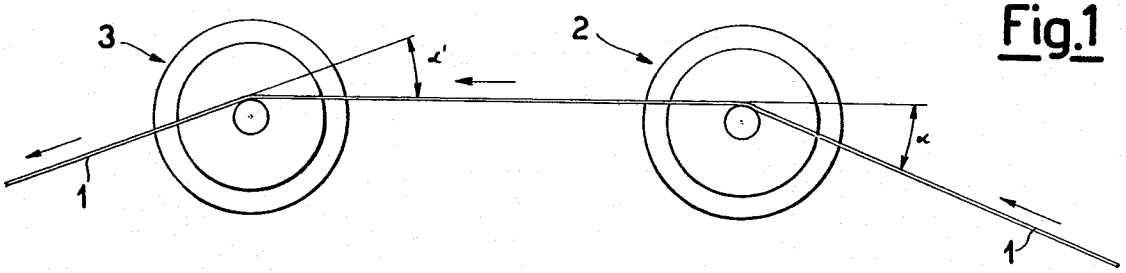
FIG. 1 is a side view of an embodiment showing two consecutive tensioning elements.

The invention can be implemented with one or more tensioning elements in series according to the required graduality of tensioning to be conferred to the yarn.

The yarn to be tensioned 1 moves from right to left, encountering firstly the tensioning element 2 and then the tensioning element 3, these being identical.

The tensioning element consists of an idle upper disc 4 supported by a fixed ring 5 which allows it to rotate but not to undergo axial movement.

The lower disc 6 is of more complicated construction.

Figure 2:
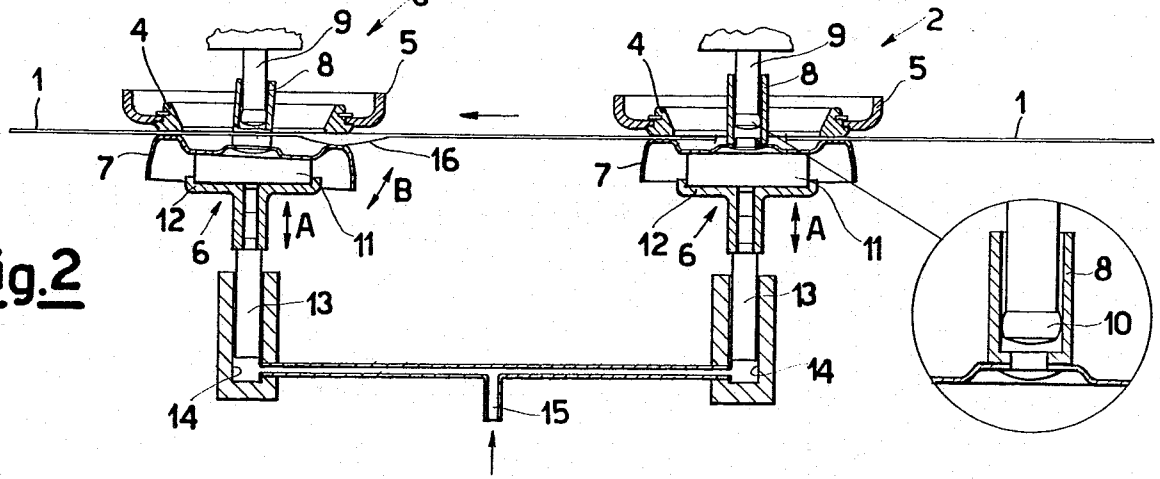
FIG. 2 is a top, schematic view showing two tensioning elements in series.

The terms "upper" and "lower" relate to the position shown in FIG. 2. In actual fact, these discs are generally disposed vertically, with their axis of rotation horizontal.

The disc 6 consists of a circular rotary ring 7 shaped with rounded edges consistent with the disc 4 with which it is in contact, at the centre of said ring 7 there being positioned the pin 8 which rotates rigidly with the disc 6. The pin 8 consists of a hollow cylinder in which a fixed insert is disposed consisting of a fixed pin 9—of transverse dimension substantially less than the cavity of the rotary pin 8—having a substantially spherical terminal end 10 of such a size that it precisely engages the coaxial cylindrical cavity of the rotary pin 8.

The element 8 is supported by a pad 11 of deformable material, for example felt, which connects it to the support cap 12 which in its lower part carries an element comprising an axial cylindrical cavity in which a support pin in the form of a piston 13 is disposed and slides in the direction of the arrow A within a cavity 14 kept under controlled pressure by feeding air at moderate pressure through the pipe 15.

It is apparent that the compression force between the upper disc and lower disc can be adjusted by adjusting the pressure of the air fed through 15.

The operation of the tensioning device according to the invention when a yarn irregularity reaches the tensioning device is described hereinafter.

The yarn slides from right to left at high speed, being deviated in its path through a certain angle $\alpha$ on entering the tensioning element 2 and $\alpha'$ on leaving the tensioning element 3.

These angles must be of positive value in order to ensure that the yarn remains continually in contact with the rotary pins 8 of each tensioning element. The length of the portion of yarn in contact with the pins 8 can be varied by varying the angles $\alpha$ and $\alpha'$.

The yarn entrains by friction the upper idle disc 4, the ring 7 and the pin 8, which rotate, the entrainment force exerted on the tensioning element corresponding to the tension transmitted to the yarn.

The entrainment action can be increased or decreased by varying the compression force between the discs, ie by varying the pressure in the pipe 15. If for example a yarn irregularity—indicated with obvious exaggeration by 16—should reach the tensioning element disposed on the left and indicated by 3, the circular ring 7 inclines in accordance with the arrow B towards the irregularity, firstly in a clockwise direction as the irregularity traverses its right hand inlet edge and then in the opposite direction as the irregularity traverses its left hand outlet edge.

The opposite edge remains in any event engaged as the pivoting movement is both guided by the engagement between the substantially spherical surface of the terminal end 10 and the cylindrical cavity of the pin 8, and compensated by the deformable pad 11 and the travel of the piston 13.

It will be noted that even during passage of the yarn irregularity, the tensioning element remains engaged and is entrained by the movement of the yarn, to thus transmit tension to the yarn continuously and reliably.

In a modified embodiment, the deformable element 11 which enables the effects of the concentrated yarn irregularities to be compensated and damped can be inserted into the first disc assembly, for example into the support for the fixed ring 5, instead of in the second disc assembly which is shown in FIG. 2 in the lower position. In further modified embodiments, the compression between the two discs can be provided by springs or counterweights connected to suitable lever mechanisms.

We claim:

1. A yarn tensioning apparatus for production and finishing operations on crude yarn comprising one or more pairs of discs in series, each of said pair of discs comprising:

(a) a rotable first disc having a fixed ring connected thereto which permits rotation of said first disc but prevents axial movement thereof;

(b) a second disc, pressing against said first disc, capable of rotary movement about its axis and capable of axial movement which comprises:

(i) a rotary ring having inner and ouer surfaces, said outer surface of said rotary ring contacting said first disc;

(ii) a hollow rotary pin extending from and fixed to the center of said outer surface of said rotary ring, said pin passing through the centers of said fixed ring and said first disc, and wherein the yarn entrains by frictional contact said rotary pin as well as said first disc and said rotary ring;

(iii) a fixed insert pin positioned within said hollow rotary pin which permits oscillatory movement of the axis of rotation of said second disc; and (c) a compression force means having a deformable element confined within one of said discs and coupled to one of said discs to vary the compression force between said first and second discs.

2. The apparatus according to claim 1, wherein said compression force comprises:

(a) said deformable element having a front and back surface, said front surface of said deformable element being in contact with said inner surface of said rotary ring;

(b) a support cap positioned against said back surface of said pad of deformable material and having an axial cylindrical cavity normal to said pad;

(c) a piston positioned within said cylindrical cavity of said support cap; and (d) air pressure adjustment means operatively coupled to said piston for varying the compression force between said first disc and said second disc.

3. The apparatus according to claim 2, wherein said deformable element is felt.

4. A yarn tensioning apparatus for production and finishing operations on crude yarn comprising one or more pairs of discs in series, each of said pair of discs comprsing:

(a) a rotatable first disc having a fixed ring connected thereto which permits rotation of said first disc but prevents axial movement thereof;

(b) a second disc, pressing against said first disc, capable of rotary movement about its axis and capable of axial movement which comprises:

(i) a rotary ring having inner and outer surfaces, said outer surface of said rotary ring contacting said first disc;

(ii) a hollow rotary pin extending from and fixed to the center of said outer surface of said rotary ring, said pin passing through the centers of said fixed ring and said first disc, and wherein the yarn entrains by frictional contact said rotary pin as well as said first disc and said rotary ring;

(iii) a fixed insert pin positioned within said hollow rotary pin which permits oscillatory movement of the axis of rotation of said second disc;

(c) a deformable element inserted into said second disc; and (d) a compression force means in contact with said deformable element to vary the compression force between said discs.

* * * * *